US008602089B2

(12) United States Patent
Singh et al.

(10) Patent No.: US 8,602,089 B2
(45) Date of Patent: Dec. 10, 2013

(54) HEAT EXCHANGER APPARATUS FOR ACCOMMODATING THERMAL AND/OR PRESSURE TRANSIENTS

(75) Inventors: Krishna P. Singh, Jupiter, FL (US); Ranga Nadig, Cherry Hill, NJ (US)

(73) Assignee: Holtec International, Inc.

( * ) Notice: Subject to any disclaimer, the term of this patent is extended or adjusted under 35 U.S.C. 154(b) by 912 days.

(21) Appl. No.: 12/127,459

(22) Filed: May 27, 2008

(65) Prior Publication Data

US 2008/0314570 A1 Dec. 25, 2008

Related U.S. Application Data

(60) Provisional application No. 60/942,893, filed on Jun. 8, 2007, provisional application No. 60/940,299, filed on May 25, 2007.

(51) Int. Cl.

| | |
|---|---|
| ***F28F 7/00*** | (2006.01) |
| ***F28F 9/02*** | (2006.01) |
| ***F28D 7/00*** | (2006.01) |

(52) U.S. Cl.

USPC ..... 165/83; 165/158; 165/159

(58) Field of Classification Search

USPC ..... 165/158, 159, 81–83

See application file for complete search history.

(56) References Cited

U.S. PATENT DOCUMENTS

| | | | | | |
|---|---|---|---|---|---|
| 1,868,657 | A | * | 7/1932 | Brown et al. | 165/75 |
| 2,774,575 | A | * | 12/1956 | Walter | 165/82 |
| 3,850,231 | A | * | 11/1974 | Creek | 165/83 |
| 4,197,907 | A | * | 4/1980 | Smith | 165/76 |
| 4,249,593 | A | * | 2/1981 | Bieberbach et al. | 165/70 |
| 5,203,405 | A | * | 4/1993 | Gentry et al. | 165/160 |
| 6,779,596 | B2 | * | 8/2004 | Wanni et al. | 165/158 |

* cited by examiner

*Primary Examiner* — Ljiljana Ciric
*Assistant Examiner* — Ignacio E Landeros
(74) *Attorney, Agent, or Firm* — The Belles Group, P.C.

(57) ABSTRACT

A heat exchanger apparatus for accommodating thermal and pressure transients. In one embodiment, the heat exchanger apparatus comprises: a first outer shell having an open end and an end wall; an inner shell having a cavity, the inner shell extending through the end wall of the first outer shell; a first tube sheet having a rim portion having a design feature for allowing the rim portion to act as an expansion joint; the outer rim portion of the first tube sheet connected to the first outer shell so as to enclose the open end of the first outer shell and form a first header cavity between the first outer shell and the inner shell; a clearance existing between the inner shell and the first tube sheet; a plurality of holes in the inner shell that form passageways between the first header cavity and the cavity of the inner shell; a first end cap connected to the rim portion of the first tube sheet so as to form a first plenum on the other side of the first tube sheet; a plurality of tubes located in the cavity of the inner shell and operably connected to the first tube sheet; an opening in the first outer shell for flowing a shell-side fluid into and/or out of the first header cavity; and an opening in the first end cap for flowing a tube-side fluid into and/or out of the first plenum.

10 Claims, 6 Drawing Sheets

13
3
20
21
16
16
16
46
3
3
3

HEAT EXCHANGER APPARATUS FOR ACCOMMODATING THERMAL AND/OR PRESSURE TRANSIENTS

CROSS-REFERENCE TO RELATED PATENT APPLICATIONS

The present patent application claims of the benefit of U.S. Provisional Patent Application 60/942,893, filed Jun. 8, 2007 and U.S. Provisional Patent Application 60/940,299, filed May 25, 2007, the entireties of which are hereby incorporated by reference as fully set forth herein.

FIELD OF THE INVENTION

The present invention relates generally to the field of heat exchangers and specifically to single or multi-pass heat tubular exchangers designed to have long service life under thermal and pressure transients.

BACKGROUND OF THE INVENTION

Generally, a simple single or multi-pass tubular heat exchanger typically consists of a shell (a large vessel) with a bundle of tubes inside of the shell. Two fluids, of different starting temperatures, flow through the heat exchanger. One fluid flows inside of the tubes (typically a gas such as steam) while a second fluid flows outside of the tubes through the shell (typically a liquid such as water. Thus, heat is transferred between the two fluids without direct contact between the two fluids. The fluid flowing inside of the tubes is known as tube-side fluid, while the fluid flowing outside of the tubes is known as shell-side fluid. During normal operation, heat will be transferred from the hotter fluid, through the walls of the tubes, and into the cooler fluid. Depending upon the desired results, heat is transferred either from tube-side to shell-side or vice versa.

Referring to FIG. 1, an example of a typical prior art single-pass heat exchanger 90 is schematically illustrated. At each end of the prior art heat exchanger 90 there is a tube-side fluid plenum 91. In a multi-pass heat exchanger, the plenum is at only one end of the heat exchanger. The plenum 91 is filled with tube-side fluid and a tubesheet 92 is positioned between the plenum 91 and the shell-side chamber 93. The tubesheet 92 generally has a solid outer rim 94 and a perforated zone 95 through which the ends of each tube 96 are connected to the plenums 91. The solid outer rim 94 is connected directly to the shell 97.

One of the challenges to the long-term reliability of such classical heat exchangers comes from the large number of thermal transients. These transients produce severe stresses in the perforated region 95 of the tubesheet 92. In such classical heat exchanger designs, the flow of tubeside fluid through the tubesheet 92, coupled with the reduced metal mass of the perforated zone 95, has the net effect of producing a temperature profile in the interior that is substantially different from the solid rim region 94. Variation in the temperature of both tube-side and shell-side fluids affects the stress field in the tubesheet 92, although to different levels of severity.

Variation in the temperature of the shell-side fluid with time actuates changes in the metal temperature of the tubesheet 92. However, the perforated interior 95 follows the shell-side fluid temperature variation much more closely than the outer rim 94 due to the reduced thermal mass of the former. Different temperature change rates in the rim 94 and in the interior 95 of the tubesheet 92 produce thermal stress variations. The effect of pulsations in the tube-side fluid temperature is usually far more severe. The perforated interior 95 follows the temperature of the tube-side fluid even more closely due to the extensive surface contact between the tube-side fluid and the tubesheet 92 (over the lateral surface, and inside surface of perforations). Thus the temperature ramps of the perforated region 95 and the untubed region can be significantly different. The resulting pulsation in the stresses can cause fatigue failure of the metal in the perforated zone 95, or in the rim 94, depending on the geometric dimensions of the tubesheet 92. If the tubesheet 92 is integrally welded to the channel and (or) the shell 97, then these junctions emerge as the most vulnerable spots.

DISCLOSURE OF THE INVENTION

It is therefore an object of the present invention to provide a heat exchanger apparatus that reduces the effect of thermal transient-produced stresses on the life of the heat exchanger apparatus.

Another object of the present invention to provide a heat exchanger apparatus that enables a low impingement velocity in the incoming and exiting fluid streams of the shell-side fluid.

Yet another object of the present invention is to provide a tube sheet having an integral expansion joint built into its outer rim.

Still another object of the present invention is to provide a heat exchanger apparatus that has increased service life.

These and other objects are met by the present invention, which in one aspect can be a heat exchanger comprising an end cap, an outer shell, an inner shell, a tubesheet having a groove in the outer rim portion, a flexible connection between the tubesheet and the end cap, an expansion joint between the tubesheet and the outer shell, and a plurality of slots in the inner shell.

In another aspect, the invention can be a heat exchanger apparatus comprising: a first outer shell having an open end and an end wall; an inner shell having a cavity, the inner shell extending through the end wall of the first outer shell; a first tube sheet having a rim portion having a design feature for allowing the rim portion to act as an expansion joint; the outer rim portion of the first tube sheet connected to the first outer shell so as to enclose the open end of the first outer shell and form a first header cavity between the first outer shell and the inner shell, the inner shell non-fixedly butted against a first side of the tube sheet; a plurality of holes in the inner shell that form passageways between the first header cavity and the cavity of the inner shell; a first end cap connected to the rim portion of the first tube sheet so as to form a first plenum on the other side of the first tube sheet; a plurality of tubes located in the cavity of the inner shell and operably connected to the first tube sheet; an opening in the first outer shell for flowing a shell-side fluid into and/or out of the first header cavity; and an opening in the first end cap for flowing a tube-side fluid into and/or out of the first plenum.

In yet another aspect, the invention can be a heat exchanger apparatus comprising: an inner shell forming a cavity for flowing a shell-side fluid; a plurality of tubes located within the cavity of the inner shell for flowing a tube-side fluid; a tube sheet having a rim portion adapted to act as an expansion joint, the plurality of tubes operably connected to an inner region of the tube sheet; the rim portion of the tube sheet connected to the inner shell; and an end cap connected to the rim portion of the tube sheet so as to form a tube-side fluid plenum.

In still another aspect, the invention can be a tube sheet for sue in a heat exchanger comprising: an inner region comprising a plurality of tube holes; and an outer rim portion having a design feature for allowing the rim portion to act as an expansion joint. Preferably the tube sheet is a single structure constructed of metal.

In one embodiment, the design feature comprises a groove and a flange. More particularly, in one embodiment, the design feature comprises a circumferential groove in an outer lateral surface of the rim portion of the tube sheet and a first flange extending longitudinally on one side of the groove and a second flange extending laterally on the other side of the groove.

DETAILED DESCRIPTION OF THE DRAWINGS

Figure 1:
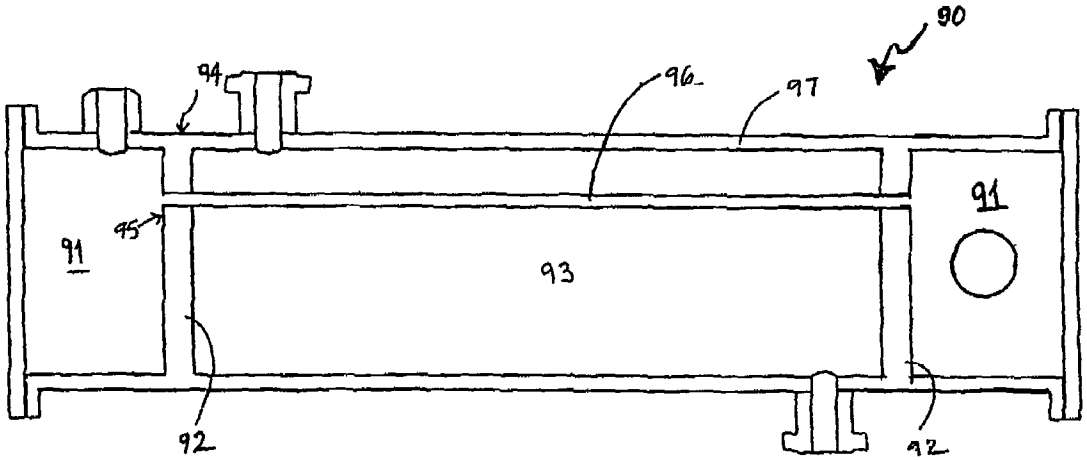
FIG. 1 is a schematic of a prior art heat exchanger.
Figure 2:
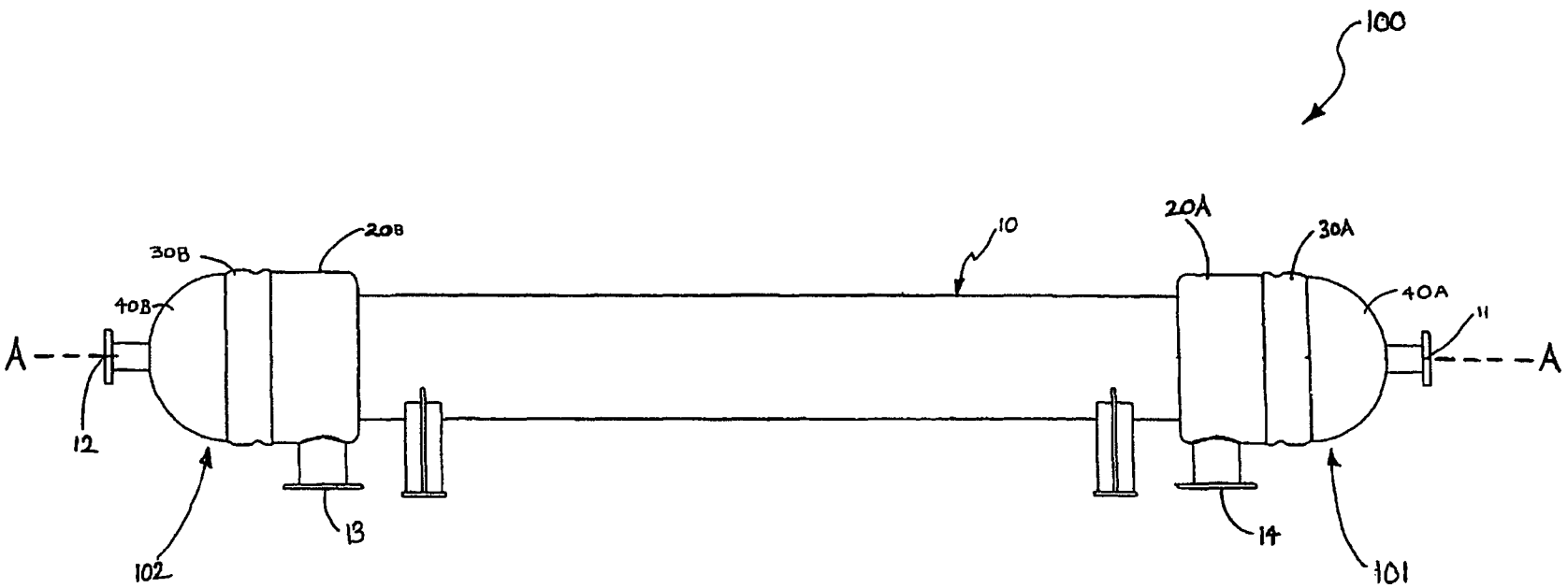
FIG. 2 is a side view of a single-pass heat exchanger according to one embodiment of the present invention.

Referring to FIG. 2, a single-pass heat exchanger 100 according to one embodiment of the present invention is illustrated. The heat exchanger 100 is an elongated tubular type heat exchanger that extends along a longitudinal axis A-A. The heat exchanger 100 generally comprises an inner shell 10, a first outer shell 20A, a second outer shell 20B, a first tube sheets 30A, a second tube sheet 30B, a first end cap 40A and a second end caps 40B. While these components are conceptually described and discussed as separate structures, in some embodiments one or more of these components may be integrally formed and/or combined. For example, if desired the first end cap 40A, the first tube sheet 30A and the first outer shell 20A can be formed as a single structure through a machining and/or other metal working process.

The outer shells 20A, 20B do not extend the full length of inner shell 10, but cover only a portion at each end. However, in other embodiments, the first and second outer shells 20A, 20B can be formed by a single tubular shell that is divided into chambers. Preferably, all components of the heat exchanger 100 are constructed of metal, such as steel, aluminum, iron, etc. Of course, other metals and materials can be used for the various components so long as the proper thermal transfer can be effectuated between the shell-side fluid and the tube-side fluid.

The heat exchanger 100 also comprises a shell-side fluid inlet 13, a shell-side fluid outlet 14, a tube-side fluid inlet 11 and a tube-side fluid outlet 12. As used herein, the term "fluid" encompasses liquids, gases, and combinations thereof.

The heat exchanger 100 comprises a first end 101 and a second end 102. The tube-side fluid inlet 11 is positioned at the first end 101 of the heat exchanger 100 while the tube-side fluid outlet 12 is positioned at the second end 102 of the heat exchanger 100. Contrarily, the shell-side fluid inlet 13 is positioned at or near the second end 102 of the heat exchanger 100 while the shell-side fluid outlet 14 is positioned at or near the first end 101 of the heat exchanger 100. Positioning the tube-side fluid inlet 11 on the same side of the heat exchanger 100 as the shell-side fluid outlet 14 while positioning the tube-side fluid outlet 12 on the same side of the heat exchanger 100 as the shell-side fluid inlet 13 results in a counter-flow arrangement for the tube-side and shell-side fluids that maximizes heat transfer. Of course, the invention is not so limited and the concurrent flow arrangement can be used.

Figure 3:
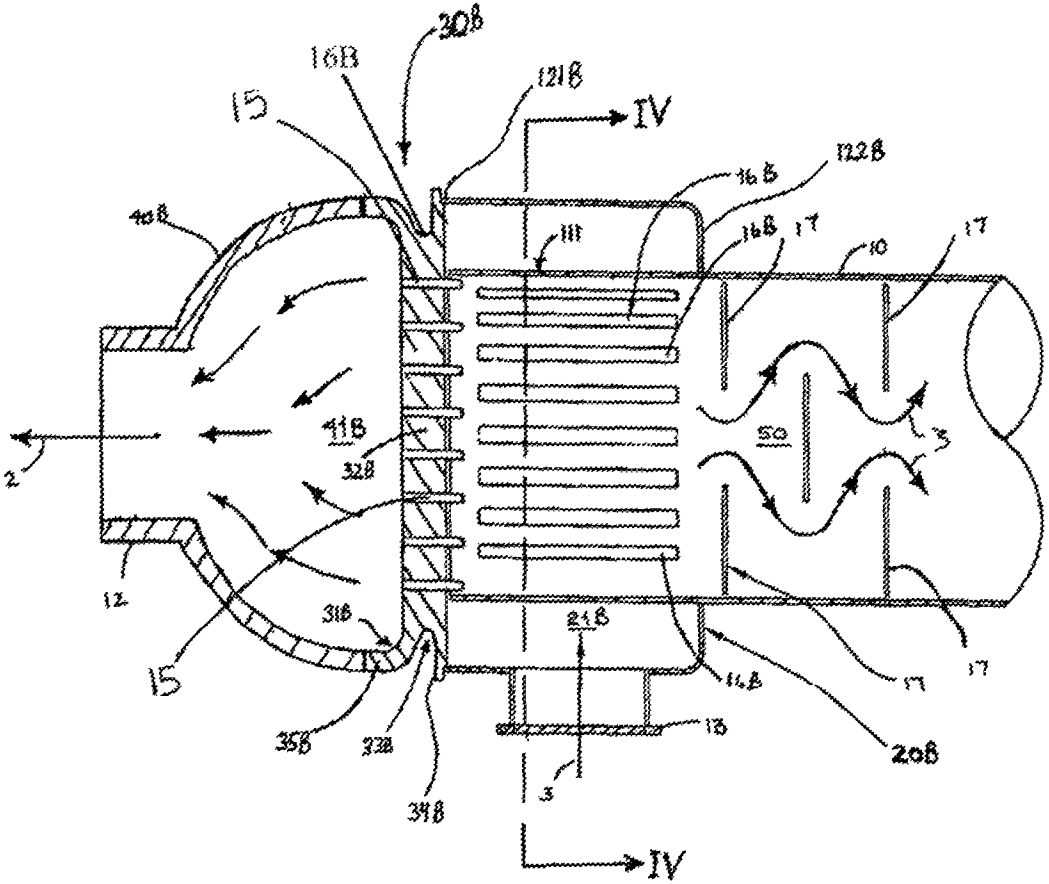
FIG. 3 is a longitudinal cross-sectional view of a section of the single-pass heat exchanger of FIG. 2.

Referring now to FIG. 3, a longitudinal cross-sectional view of a portion of the second end 102 of the heat exchanger 100 is illustrated. An identical but mirror-image geometry and structural arrangement exists for the first end 101 of the heat exchanger 100. However, in order to avoid redundancy only the second end 102 of the heat exchanger 100 will be described in detail. Of course, in some embodiments, only one end 101, 102 of the heat exchanger 100 may incorporate the inventive concepts discussed below.

The heat exchanger 100 is divided into a plurality of conceptual spatial compartments. These compartments include the tube-side fluid outlet plenum 41B, the shell-side fluid inlet header chamber 21B and the heat exchange cavity 50. The inner surface 110 of the inner shell 10 forms the heat exchange cavity 50 in cooperation with the second tube sheet 30B. The tube-side fluid outlet plenum 41B is formed by the cooperation of the second end cap 40B and the second tube sheet 30B. The shell-side fluid header chamber 21B is formed by the cooperation of the second outer shell 20B, the inner shell 10 and the second tube sheet 30B. The second tube sheet 30B separates the tube-side fluid outlet plenum 41B from both the shell-side fluid header chamber 21B and the heat exchange cavity 50.

The second outer shell 20B comprises an open end 121B at one of its ends and an end wall 122B at the other end. The second outer shell 20B circumferentially surrounds a second end portion 111 of the inner shell 10 in a concentric manner. The remainder of the inner shell 10 extends through and protrudes from the end wall 122B of the second outer shell 20B. The juncture between the end wall 122B and the inner shell 10 is welded (or otherwise joined) so that a hermetic connection is achieved. Thus, the shell-side fluid inlet header chamber 21B is formed between the outside surface of the inner shell 10 and the inside surface of the second outer shell 20B.

The second outer shell 20B comprises a shell-side fluid inlet 13 for introducing a shell-side fluid 3 into the shell-side fluid inlet header chamber 21B. The second end portion 111 of the inner shell 10 comprises a plurality of fluid distribution slots 16B that form passageways from the header chamber 21B into the heat exchange cavity 50. The slots 16 are circumferentially arranged about the second end portion 111 of the inner shell 10 in a uniform pattern to facilitate uniform fluid flow of the shell-side fluid 3 into the heat exchange cavity 50 (see FIG. 4). The shell-side fluid inlet header chamber 21B in combination with the slots 16 provide a mechanism for enabling a safely low impingement velocity in the incoming shell-side fluid stream 3 and the exiting shell-side fluid stream (not illustrated). The size and spacing of the slots 16 are designed to make the low velocity entering the shell-side fluid space 50 as uniform as practicable. This design configuration eliminates a common vulnerability in auxiliary heat exchangers in nuclear plants that, of necessity, have large water flows and relatively modest heat duties.

The second tube sheet 30B can be conceptually be divided into an annular outer rim portion 31B and an inner region 32B. Physically, however, the second tube sheet 3013 is preferably one integral structure of metal. Of course, separate components and different materials can be used if desired.

The inner region 32B comprises a plurality of openings through which the tubes 15 extend. The plurality of tubes 15 are operably coupled at their ends to the second tube sheet 30B so that fluid passageways are formed from the plenum 41B through the tubes 15 that are hermetically sealed from the heat exchange cavity 50. The tubes 15 are positioned substantially parallel to the longitudinal axis A-A of the heat exchanger 100 and perpendicular to the faces of the second tube sheet 30B. In the figures, only eight tubes 15 are shown for clarity, but the invention is not so limited and any number of tubes can be used. Additionally, the tubes 15 extend the entire length of the inner shell 10 from the second tube sheet 30B to the first tube sheet 30A. However, for the purpose of clarity of FIG. 3, the length of the tubes 15 is cut short.

The outer rim portion 31B is connected to the open end 121B of the second outer shell 20B on one side and to the second end cap 40B on the other side. These connection are preferably accomplished by welding. However, these connections are designed to be flexible connections due to the fact that the outer rim portion 31B comprises a design feature that allows the outer rim portion to flex (i.e., act as an expansion joint). In the illustrated embodiment, the outer rim portion 31B of the second tube sheet 30B comprises a groove 33B having a floor 16B, a lateral flange 34B and a longitudinal flange 35B.

The groove 33B substantially eliminates the solid outer rim portion of tube sheets used in prior art heat exchangers. While the second tube sheet 30B is rigidly connected to the second outer shell 20B and the second end cap 40B via welded connections, the second tube sheet 30B is intentionally not connected to the inner shell 10. The inner shell 10 extends close to the tubesheet 30 but is not welded to it. The inner shell 10 to tube sheet 30 junction is created by a flanged and flued expansion joint and the outer shell 20. A rigid (i.e. fixed) connection is not effectuated between the second tube sheet 30B and the inner shell 10 so that relative movement is allowed between the two. This allows the tube sheet 30B to expand and contract freely when experiencing thermal cycling and thermal transients.

Within shell-side fluid space 50 are located a plurality of fin plates 17. Fin plates 17 are designed to provide optimal uniform fluid flow through shell-side fluid space 50 and act as baffles.

Figure 4:
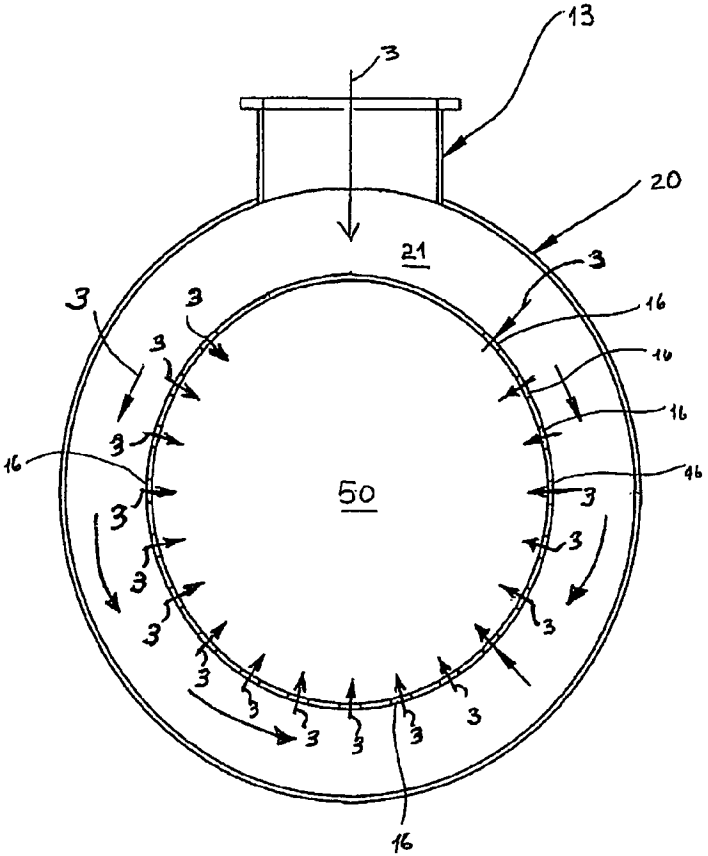
FIG. 4 is a lateral cross-sectional view of the single-pass heat exchanger of FIG. 3 along view IV-IV.

Referring to FIGS. 2-4 concurrently, in operation, tube-side fluid 2 enters through tube-side inlet 11 and flows into tube-side inlet chamber 41A (not illustrated) through a plurality of tubes 15. The fluid flows out of tubes 15 and into tube-side outlet chamber 41B. The tube-side fluid 2 is then discharged through tube-side fluid outlet 12. Shell-side fluid 3 is introduced into heat exchanger 100 through shell-side inlet 13. Shell-side fluid 3 then flows into shell-side annular inlet plenum 21B and through slots 16B into fluid space 50. Shell-side fluid 3 then flows along the outer surface of tubes 15 and then through slots 16A and into shell-side annular outlet plenum 21A (not illustrated). Shell-side fluid 3 exits heat exchanger 100 through shell-side fluid outlet 14. The positioning of the inlets and outlets 11-14 is such that the shell-side fluid and the tube-side fluid will flow in opposite directions along the length of heat exchanger 100

Figure 5:
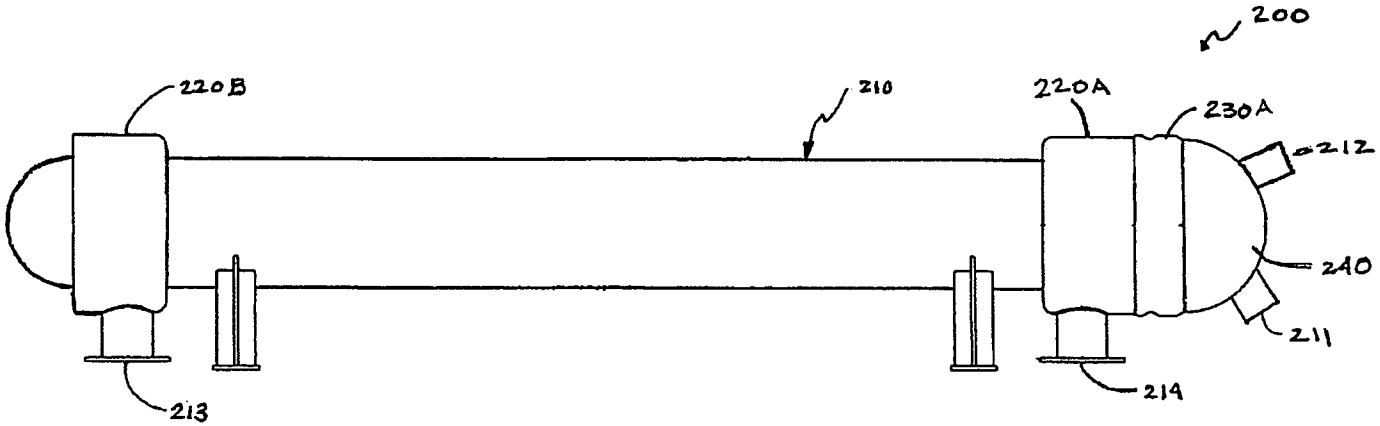
FIG. 5 is a side view of a multi-pass heat exchanger according to one embodiment of the present invention.

Referring now to FIG. 5, a multi-pass heat exchanger 200 according to an alternative embodiment of the present invention is illustrated. Multi-pass heat exchanger 200 comprises an inner shell 210, outer shells 220A, 220B, tube sheet 230 and end cap 240. Heat exchanger 100 further comprises a number of outlets and inlets 11-14 through which fluid will enter and exit various components of multi-pass heat exchanger 200. Many aspects of the multi-pass heat exchanger 200 are the same as those discussed above with respect to heat exchanger 100. To avoid redundancy only those aspects of the multi-pass heat exchanger 200 that differ from heat exchanger 100 will be discussed. Multi-pass heat exchanger 200 comprises tube-side fluid inlet 11 and tube-side fluid outlet 12. Tube-side fluid inlet 11 and tube-side fluid outlet 12 are positioned on the same end of multi-pass heat exchanger 200

Figure 6:
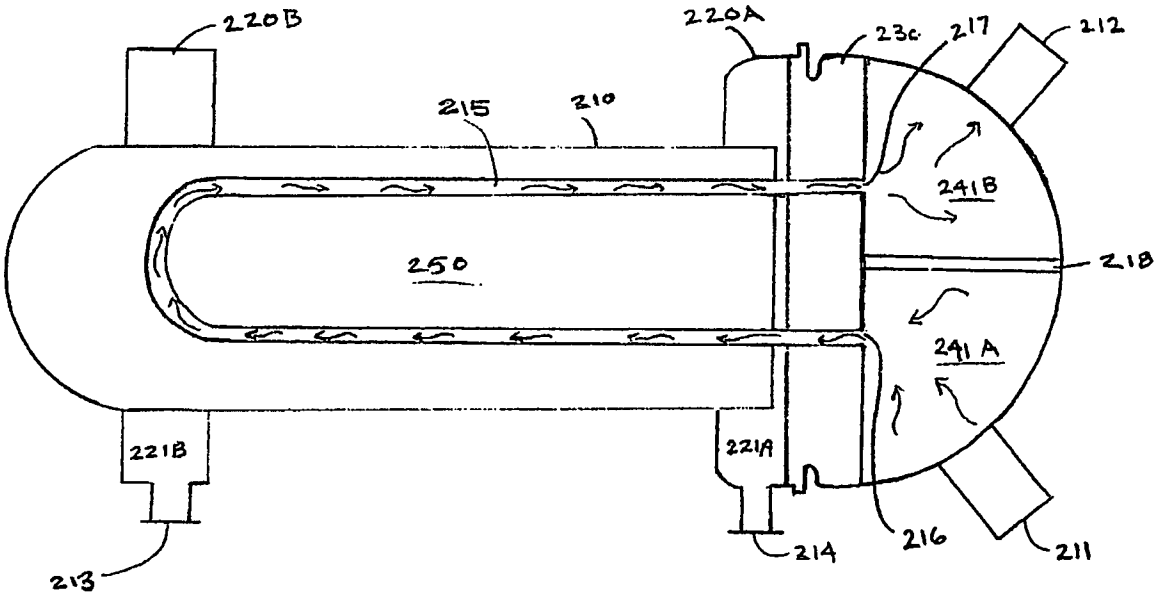
FIG. 6 is a longitudinal cross-sectional view of the multi-pass heat exchanger of FIG. 5.

Referring now to FIG. 6, a cut-away side view of multi-pass heat exchanger 200 is illustrated. For purposes of clarity, not all of the structure is illustrated in FIG. 6, notably, slots 16 and fins 17 (illustrated in FIGS. 3 and 4). However the structure and function of outer shells 220A, 220B, shell-side plenums 221A, 221B, inner shell 210, and shell-side fluid space 250 are the same as discussed above with respect to heat exchanger 100. In multi-pass heat exchanger 200, tube 215 extends from tube-side fluid inlet chamber 241A to tube side-fluid outlet chamber 241B. Only one tube 215 is illustrated for purposes of clarity, however multi-pass heat exchanger 200 can have many tubes. Tube 215 comprises tube inlet 216 and tube outlet 217. Tube inlet 216 is in fluid communication with tube-side fluid inlet chamber 241A. Tube outlet 217 is in fluid communication with tube-side fluid outlet chamber 241B. Tubes 215 run along the full length of multi-pass heat exchanger 200 and form a U at the end opposite the chambers 241A, 241B.

Tube-side fluid chambers 241A, 241B are divided by plate 218. In the illustrated embodiment, tube-side fluid chambers 214A, 214B are shown one on top of the other and separated from each other by plate 218, however the invention is not so limited. The structure can be any structure that maintains two separate chambers, for example there may be an inner chamber and an outer chamber circumferentially surrounding the inner chamber.

In operation tube-side fluid enters tune-side fluid inlet chamber 241A through tube-side fluid inlet 211 and flows into tube 215 through inlet 216. The fluid then exits tube 215 through outlet 217 and into tube-side fluid outlet chamber 241B. Tube-side fluid then exits multi-pass heat exchanger through tube-side fluid outlet 212. Shell side fluid enters multi-pass heat exchanger 200 through shell-side fluid inlet 213 and flows into shell-side annular inlet plenum 221B. The fluid then flows through slots 16B (not illustrated) and into shell-side fluid chamber 250. Shell-side fluid then exits shell-side fluid chamber 250 through slots 16A (not illustrated) enters shell-side fluid annular outlet plenum 221A and exits multi-pass heat exchanger 200 through shell-side fluid outlet 214.

While two embodiments of the present invention has been described in detail. Various alternatives, modifications and improvements should become readily apparent without departing from the scope and spirit of the invention.

What is claimed is:

1. A heat exchanger apparatus comprising:

a first outer shell having an open end and an end wall;

an inner shell haying a longitudinal axis and a cavity, the inner shell extending through the end wall of the first outer shell;

a first tube sheet having an inner region and a rim portion, the rim portion having a design feature for allowing the rim portion to act as an expansion joint, the design feature comprising a circumferential groove in an outer lateral surface of the rim portion, a first flange extending from the inner region in a direction of the longitudinal axis and a second flange extending from the inner region in a direction transverse to the longitudinal axis;

the second flange of the first tube sheet connected to the first outer shell so as to enclose the open end of the first outer shell and form a first header cavity between the first outer shell and the inner shell;

a clearance existing between the inner shell and the first tube sheet;

a plurality of holes in the inner shell that form passageways between the first header cavity and the cavity of the inner shell;

a first end cap connected to the first flange of the first tube sheet, an inner surface of the first end and an inner surface of the first flange collectively defining a first plenum on a side of the first tube sheet opposite the first header cavity;

a plurality of tubes located in the cavity of the inner shell and operably connected to the first tube sheet;

an opening in the first outer shell for flowing a shell-side fluid into and/or out of the first header cavity;

an opening in the first end cap for flowing a tube-side fluid into and/or out of the first plenum; and wherein the circumferential groove comprises a floor that is spaced a first distance from the longitudinal axis and the inner surface of the first flange is spaced a second distance from the longitudinal axis, the second distance being greater than the first distance.

2. The heat exchanger apparatus of claim 1 further comprising a plurality baffles located in the cavity of the inner shell, the plurality of tubes extending through the baffles.

3. The heat exchanger apparatus of claim 1 wherein the plurality of holes are arranged in a circumferential uniform pattern on the inner shell.

4. The heat exchanger apparatus of claim 1 wherein the connection between the first outer shell and the first tube sheet and the connection between the first end cap and the first tube sheet are welds.

5. The heat exchanger apparatus of claim 4 wherein the clearance between the inner shell and the first tube sheet permits relative movement between the inner shell and the first tube sheet during thermal expansion and/or contraction of the first tube sheet.

6. The heat exchanger apparatus of claim 1 further comprising:

a wall separating the first plenum into first and second chambers; and wherein the plurality of tubes form fluid passageways from the first chamber to the second chamber.

7. The heat exchanger apparatus of claim 1 further comprising:

a second outer shell having an open end and an end wall;

the inner shell extending through the end wall of the second outer shell, the first outer shell located at a first end of the inner shell and the second outer shell located at a second end of the inner shell;

a second tube sheet having a rim portion having a design feature that allows the rim portion of the second tube sheet to flex;

the outer rim portion of the second tube sheet connected to the second outer shell so as to enclose the open end of the second outer shell and form a second header cavity between the second outer shell and the inner shell, the inner shell non-fixedly sealed against a first side of the second tube sheet;

a plurality of holes in the inner shell that form passageways between the second header cavity and the cavity of the inner shell;

a second end cap connected to the rim portion of the second tube sheet and forming a second plenum on the other side of the second tube sheet;

the plurality of tubes extending through the cavity of the inner shell and operably connected to the first and second tube sheets so as to form passageways between the first and second plenums;

an opening in the second outer shell for flowing a shell-side fluid into and/or out of the second header cavity; and an opening in the second end cap for flowing the tube-side fluid into and/or out of the second plenum.

8. The heat exchanger apparatus of claim wherein the first outer shell has an outer surface, the second flange extending laterally from the inner region of the first tube sheet to beyond the outer surface of the first outer shell.

9. The heat exchanger apparatus of claim 1 wherein the second flange of the first tube sheet is connected to the first outer shell at a location that is spaced a third distance from the longitudinal axis, the third distance being greater than the first distance.

10. A heat exchanger apparatus comprising:

an outer shell having an open end and an end wall;

an inner shell forming a cavity, the inner shell having a longitudinal axis;

a tube sheet having an inner region and a rim portion, a plurality of tubes located within the cavity of the inner shell and operably connected to the inner region of the tube sheet;

a first flange extending from the inner region of the tube sheet in a direction of the longitudinal axis;

a second flange extending from the inner region of the tube sheet in a direction transverse to the longitudinal axis, the second flange connected to the outer shell;

a circumferential groove having a floor formed into an outer surface of the rim portion;

an end cap connected to the first flange, an inner surface of the end cap and an inner surface of the first flange collectively defining a tube-side fluid plenum; and wherein the floor of the circumferential groove is spaced from the longitudinal axis by a first radial distance and the inner surface of the first flange is spaced from the longitudinal axis by a second radial distance, the second radial distance being greater than the first radial distance.

* * * * *